US006729233B2

(12) United States Patent
Knopp et al.

(10) Patent No.: US 6,729,233 B2
(45) Date of Patent: May 4, 2004

(54) SHEET GUIDE DEVICE IN A ROTARY PRINTING MACHINE

(75) Inventors: Lucas Knopp, Freigericht (DE); Peter Wulf, Cologne (DE); Frank Seidel, Dreieich (DE); Steffen Flotow, Grosskrotzenburg (DE); Udo Trillig, Offenbach (DE)

(73) Assignee: MAN Roland Druckmaschinen AG, Offenbach/Main (DE)

( * ) Notice: Subject to any disclaimer, the term of this patent is extended or adjusted under 35 U.S.C. 154(b) by 0 days.

(21) Appl. No.: 10/010,215

(22) Filed: Dec. 4, 2001

(65) Prior Publication Data

US 2002/0069775 A1 Jun. 13, 2002

(30) Foreign Application Priority Data

Dec. 6, 2000 (DE) ..... 100 60 557

(51) Int. Cl.[7] ..... B41F 13/24

(52) U.S. Cl. ..... 101/232; 101/230; 101/216; 101/183; 101/184

(58) Field of Search ..... 101/229, 183, 101/230, 184, 185, 231, 232; 271/195

(56) References Cited

U.S. PATENT DOCUMENTS

| | | | | | |
|---|---|---|---|---|---|
| 4,479,645 | A | * | 10/1984 | Pollich | 271/183 |
| 4,572,071 | A | | 2/1986 | Cappel et al. | |
| 5,497,987 | A | * | 3/1996 | Henn et al. | 271/204 |
| 5,669,603 | A | * | 9/1997 | Detmers et al. | 271/183 |
| 5,809,885 | A | * | 9/1998 | Koch et al. | 101/232 |
| 5,816,155 | A | * | 10/1998 | Stephan | 101/232 |
| 5,931,093 | A | * | 8/1999 | Walther et al. | 101/232 |
| 6,254,089 | B1 | * | 7/2001 | Becker et al. | 271/276 |
| 6,349,641 | B1 | * | 2/2002 | Bayer et al. | 101/142 |

FOREIGN PATENT DOCUMENTS

| | | | | |
|---|---|---|---|---|
| DE | 3411029 | | 10/1985 | |
| DE | 196 38 311 | A1 | 5/1997 | |
| DE | 298 17 317 | U1 | 1/1999 | |
| EP | 0 156 173 | B1 | 12/1989 | |
| GB | 2341850 | A * | 3/2000 | B41F/21/00 |

* cited by examiner

*Primary Examiner*—Ren Yan
*Assistant Examiner*—Andrea H. Evans
(74) *Attorney, Agent, or Firm*—Leydig, Voit & Mayer, Ltd.

(57) ABSTRACT

A sheet guide apparatus for use in a rotary printing press which is adapted for the smear and mark free transfer of sheets between two sheet holding and transfer systems, such as a pair of sheet-carrying cylinders or a sheet-carrying cylinder and circulating sheet conveyor. The sheet guide apparatus includes a sheet guide having a guide surface disposed beneath the transfer area, and a pneumatic system for blowing a positive pressure air stream in the direction of a transfer area or tangent point between the sheet holding and transfer systems. A further pneumatic system optionally may be provided for drawing or blowing air through apertures in the guide surface.

17 Claims, 2 Drawing Sheets

SHEET GUIDE DEVICE IN A ROTARY PRINTING MACHINE

FIELD OF THE INVENTION

The invention relates to a sheet guide device in a rotary printing machine, and more particularly, to an air assisted sheet guide device.

BACKGROUND OF THE INVENTION

A sheet guide device of such type is disclosed in EP 0 156 173 B1. In that case, the guide device is formed by a plurality of air supply boxes or flow ducts composed of modules and coupled to fans along a continuous guide surface. The air supply boxes have openings or air nozzles, which can be operated optionally to direct forced blown air, or to draw a vacuum, by means of fans.

In addition, it is known for such air supply boxes to be constructed with comb-like ends, which are adjacent to the transfer area of two sheet holding systems. Such a construction is disclosed, for example, in DE 298 17 317 U1.

DE 196 38 311 A1 discloses a method of guiding a sheet and a guide device for a rotary printing machine. The guide device is arranged in the sheet inlet as a suction funnel underneath the tangent point (i.e. the transfer area between two sheet holding systems) of a sheet-carrying cylinder arranged upstream of an impression cylinder. The suction tunnel can be operated only with vacuum. In addition, a sheet guide device that can be operated with mechanical and/or pneumatic means is arranged underneath the sheet-carrying cylinder. One embodiment of a sheet guide device with pneumatic operating means has a comb plate oriented in the direction of the tangent point.

The foregoing arrangements are disadvantageous because in the transfer area between two sheet holding systems of rotary printing machines having sheet-carrying cylinders a sheet has to pass through a transition in a sheet outlet and also in a sheet inlet. There is a transition when the sheet resting on a sheet-carrying cylinder is transferred to a sheet-carrying cylinder arranged downstream of a sheet outlet and is guided by means of a guide device. There also is a transition to the sheet inlet when the sheet, guided by means of a guide device, is transferred to a downstream sheet-carrying cylinder and conveyed resting on that sheet-carrying cylinder.

If a suction effect is permanently present at such transitions, as in DE 196 38 311 A1, the sheet is drawn against a comb plate or guide rods. In that case, the risk increases for smearing or marking the sheet material. This is particularly disadvantageous when sheets are printed on both sides in recto and verso printing.

OBJECTS AND SUMMARY OF THE INVENTION

It is an object of the invention to provide an air assisted sheet guiding device that is adapted for more reliable smear and mark-free sheet conveyance in transition areas between two sheet holding systems having an associated sheet guide device.

Another object is to provide an air assisted sheet guide device as characterized above which can be universally used in recto printing or recto and verso printing.

The invention is carried out by a sheet guide device which has a guide surface and a large number of nozzles that operate on an air blowing/vacuum or venturi principle, to ensure a proper sheet guidance at the sheet transfer area. Optionally, openings fed with blown air or vacuum pressure also can be used in the guide surfaces.

A guide surface of this type is provided adjacent to the transfer area, such as the tangent point of two sheet holding systems, for example gripper systems. In this case, the sheet holding systems are arranged on a sheet-carrying cylinder, for example a transfer cylinder, and a following sheet-carrying cylinder, for example an impression cylinder, or a sheet-carrying cylinder, for example an impression cylinder and a following circulating chain system, for example, a gripper system at the delivery station.

A first advantage of a sheet guide device according to the invention is that it ensures smear-free sheet conveyance in the transfer area between two sheet holding systems and the associated guide device. For this purpose, underneath the transfer area (i.e. tangent point) of the sheet holding systems, a blown air stream is aimed in the direction of the sheet outlet and/or in the direction of the sheet inlet and against the respective sheet. The blown air has low blowing pressure or a low velocity and a high volume flow. A blown air stream of this type ensures smear-free sheet conveyance for sheets created in recto printing and also in recto and verso printing.

It is advantageous in this case that the sheet transferred from the upstream sheet-carrying cylinder to the following sheet-carrying cylinder or to a circulating chain system is carried through the transition to the guide device (sheet outlet) or from the guide device (sheet inlet) without contact with the guide device, and therefore smear-free, by reason of the directed blown air stream. By means of a controllable blown air intensity, virtually ideal tangential guidance of the sheet to the sheet guide device can be effected. The intensity of blown air also can be metered in order to avoid uncontrolled lifting of the sheet. Uncontrolled lifting, for example, leads to problems when the sheet is directed into the next printing zone.

Also advantageous is the fact that, by means of a controllable blown air intensity, the sheet conveyance can be implemented universally in a smear-free manner for various types of sheets and for all modes of operation (i.e. recto printing, recto and verso printing). Therefore, by means of the sheet guide device according to the invention, high printing speeds also can be implemented with a quiet sheet run.

Other objects and advantages of the invention will become apparent upon reading the following detailed description and upon reference to the drawings, in which:

Figure 1:
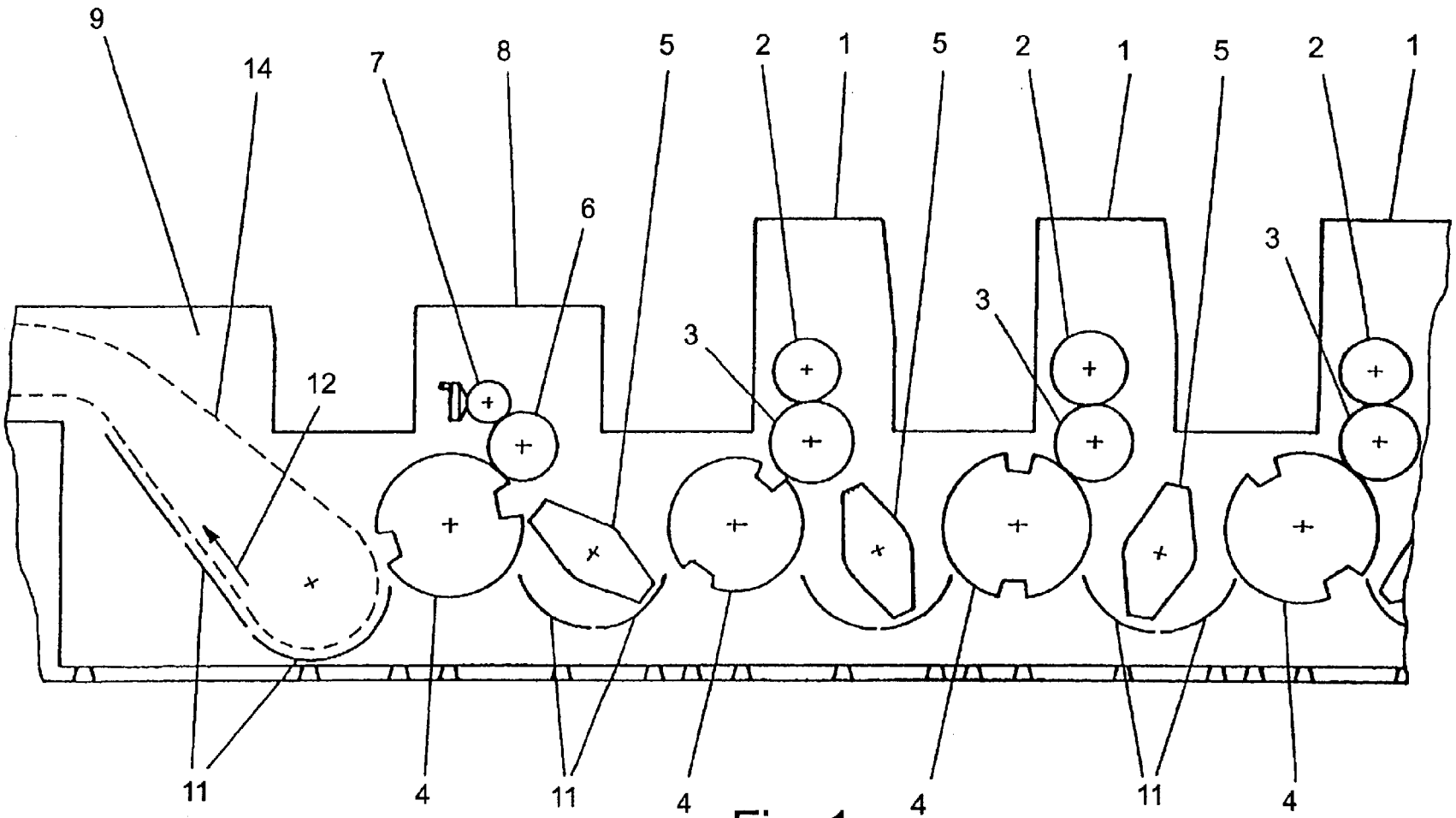
FIG. 1 is a schematic side elevation of a sheet-fed rotary printing machine of an in-line design having sheet guide devices in accordance with the present invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENT

Turning now more particularly to FIG. 1 of the drawings, there is shown an illustrative sheet-fed rotary printing machine having a plurality of printing units 1 and a varnishing unit 8, which are arranged in a line in the conveying direction 12.

Arranged downstream of the varnishing unit 8 in the conveying direction 12 is a delivery unit 9 with a circulating conveyor system 14, which transports the sheets by grippers to a delivery stack where they are deposited. Each printing unit 1 comprises a plate cylinder 2, a blanket cylinder 3, and a sheet-carrying cylinder 4 which in this instance is an impression cylinder. Each plate cylinder 2 has a respective inking unit and, if appropriate, a damping unit. The varnishing unit 8 has a metering system 7, for example a chamber-type doctor system with an engraved applicator roll, which is functionally connected to a form cylinder 6. The form cylinder 6 in turn has an associated sheet-carrying cylinder 4, which in this case again is an impression cylinder.

Figure 2:
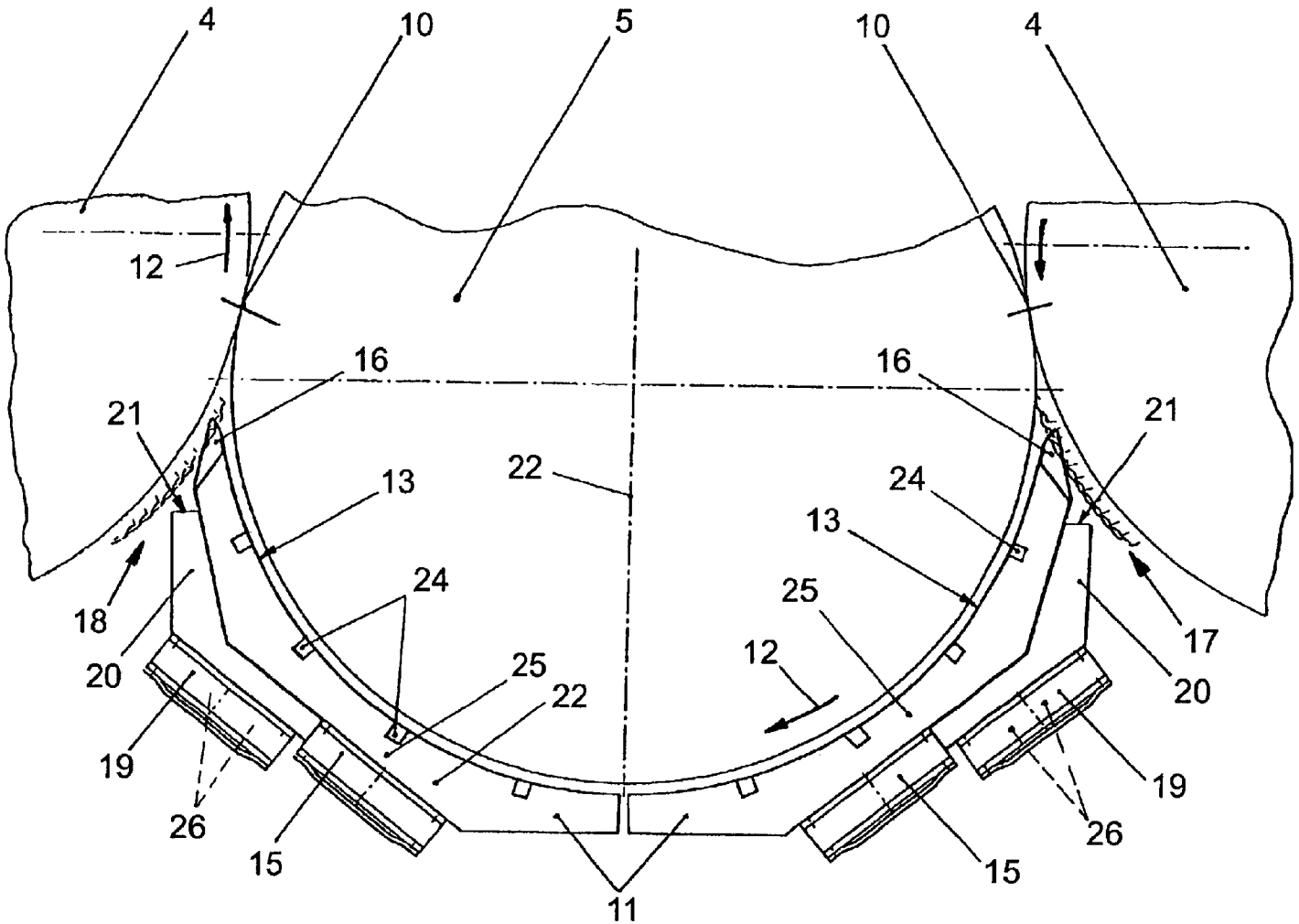
FIG. 2 is an enlarged fragmentary view of a sheet guide device according to the invention at sheet outlet and sheet inlet transfer locations in the illustrated machine.

Between the printing units 1 and between the last printing unit 1 and the varnishing unit 8, sheet-carrying cylinders 5 are arranged, which may be transfer drums and/or turner drums. Such sheet-carrying cylinders 5, as is known in the art, may have a complete outer periphery (as shown in FIG. 2) or, alternatively, have a periphery with secant-like or curved sides (as shown in FIG. 1). The sheet-carrying cylinders 4, 5 and the conveyor systems 14 have sheet holding systems arranged on their peripheries, preferably gripper systems, for engaging and transporting sheets.

In the illustrated embodiment, sheet transfer points are located at the tangent points between respective sheet holding and transfer systems. More particularly, the transfer areas 10 are located at the respective tangent points between the sheet-carrying cylinder 5 and the upstream sheet-carrying cylinder 4, and between the sheet-carrying cylinder 5 and the respective downstream sheet-carrying cylinder 4. In the sheet transfer areas (i.e. tangent points) of two sheet holding systems, as is known in the art, a sheet is transferred from a first gripper system to a second gripper system. As shown in FIG. 2, the transfer areas between two sheet-carrying cylinders 4, 5, in the conveying direction, includes a first transfer area 10 with a following sheet outlet 17 and a sheet inlet 18 with a following transfer area 10.

To assist in guiding movement of sheets leaving the outlet 17 and entering the inlet 18, a sheet guide device 11 is provided, which in this case is fixed to the frame of the printing machine. In the present case, two modular constructed sheet guide devices 11 are provided underneath the sheet-carrying cylinder 5 in mirror image fashion in relation to each other, with reference to an axis of symmetry 22.

In accordance with the invention, each sheet guide device is adapted to pneumatically assist guidance of sheets from and to the outlet and inlets respectively and to positively direct a positive air flow into the transfer areas 10 to prevent sheet marking and smearing. Each sheet device 11 has a box-like construction, which in this case defines a first pneumatic flow duct 25 and which has a guide surface 13 with openings, such as defined by nozzles 24 through which either blown air may be directed or a vacuum may be drawn. For this purpose, each sheet guide device 11 is provided with a first pneumatic system 15, preferably comprising at least one fan which communicates with the first flow duct 25 for drawing a vacuum through the openings or for blowing air for ensuring reliable sheet guidance along the surface 13.

Each sheet guide device 11 is arranged underneath the sheet-carrying cylinder 5 at a defined distance from its periphery in order to ensure non-contact, floating sheet conveyance. The sheet guide device 11 adjacent to the sheet outlet 17 has a comb plate 16 (for example such as disclosed by DE 196 38 311 A1 or DE 298 17 317 U1), arranged upstream and pointing in the direction of the transfer area 10. The comb plate 16, as will become apparent, supports the sheet conveyance in the sheet outlet 17 mechanically or pneumatically. The comb plate 16 extends over the maximum format width and reaches as close as possible to the transfer area 10.

In carrying out the invention, each sheet guide device further is adapted to positively blow air toward the respect sheet transfer area 10 to facilitate direction of the sheet into and through the transfer area. In the illustrated embodiment, in the sheet outlet 17 underneath the transfer area 10, a second, separately controllable pneumatic system 19 is arranged in fixed relation to the frame. The pneumatic system 19 preferably includes a plurality of fans 26 and produces a blown air stream at low pressure and high volume flow against the underside of the sheet, in the direction of the transfer area 10 (i.e. tangent point). In a preferred design, the second pneumatic system 19 is arranged on the sheet guide device 11 and produces the necessary blown air stream against the underside of the sheet.

In the illustrated embodiment, a second flow duct 20 is arranged underneath the first flow duct 15 and is functionally connected to the second pneumatic system 19. The second pneumatic system 19 is arranged on the rear of the second flow duct 20 and supplies the flow duct 20 so that a stream of air at low blowing pressure and high volume flow emerges from a discharge outflow opening 21 in the end of the flow duct 20. In this case, the second flow duct 20 has at least one outflow opening 21 for the blown air, and preferably a plurality of outflow openings 21 extends over the maximum format width, which are aimed in the direction of the transfer area 10 (tangent point) against the underside of the sheet and into the sheet outlet 17.

If a mechanically or pneumatically acting comb plate 16 is arranged upstream of the sheet guide device 11 (in the direction of the sheet outlet 17) as depicted in the illustrated embodiment, then the blown air emerging from the outflow opening 21 flows through the free spaces between the prongs of the comb plate 16 in the direction of the transfer area 10.

Analogous to the sheet outlet 17, a second, separately controllable pneumatic system 19 is fixed to the printing machine frame at the sheet inlet 18, in mirror-image fashion to the axis of symmetry 22 and underneath the downstream transfer area 10, and is preferably formed by a plurality of fans and, analogous to the sheet outlet 17, produces a blown air stream at low blowing pressure and high volume flow against the underside of the sheet and in the direction of the transfer area 10. In this instance, the second pneumatic system 19 is arranged on the first flow duct of the sheet guide device 11 and produces the necessary blowing air stream against the underside of the sheet in the direction of the transfer area (tangent point of sheet-carrying cylinder 5 and downstream sheet-carrying cylinder 4).

In the preferred embodiment, a second flow duct 20 is arranged underneath the first flow duct sheet guide device 11, and is functionally connected to the second pneumatic system 19. The second pneumatic system 19 is arranged on the rear of the second flow duct 20 and supplies the flow duct 20 with air via an opening 21, so that a flow at low blowing pressure and low flow velocity and high volume flow, which is aimed substantially in the direction of the transfer region 10 (tangent point) and therefore onto the underside of the sheet, emerges at an outflow opening 21. In this case, the second flow duct 20 again has at least one outflow opening 21 which extends over the maximum format width for the blown air and which is aimed in the direction of the transfer area 10 (i.e. tangent point) against the underside of the sheet and into the sheet inlet 18. Alternatively, a plurality of outflow openings 21 are arranged to be distributed over the maximum format width and are aimed in the direction of the transfer area 10 against the underside of the sheet.

The mode of action is as follows: in the upstream transfer area 10 in the conveying direction 12, the sheet carried in the grip of the grippers is transferred by the rotating sheet-carrying cylinder 4 (impression cylinder) to the rotating sheet-carrying cylinder 5 (transfer cylinder) and transported into the sheet outlet 17. If the sheet-carrying cylinder 5 is designed as a transfer cylinder, the sheet is transferred with the leading edge in the transfer area 10, a remaining part of the sheet still adhering to the peripheral surface of the upstream sheet-carrying cylinder 4 after the transfer. The blown air stream (low blowing pressure, high volume flow) produced by the second pneumatic system 19 in the direction of the sheet outlet 17 supports the underside of the sheet in the transition from the sheet-carrying cylinder 4 to the comb plate 16 or to the sheet guide device 11. The blown air stream produced, as a result of the low blowing pressure and high volume flow, then has the effect that the sheet is guided smoothly in this transition without settling on the comb plate 16 or the guide surface 13 of the sheet guide device 11 (which leads to smearing or marking). After the transition, the sheet is guided by the sheet guide device 11 in conjunction with the first pneumatic system 15. The second pneumatic system 19 can be controlled individually in order to support the underside of the sheet, for example from the point of view of the printed subject, the elasticity of the sheet material, and the like. In the preferred design, the pneumatic system 19 has a plurality of fans, for example axial fans, which are individually controllable.

Following the comb plate 16 in the sheet outlet 17, in the conveying direction 12, the sheet passes the guide surfaces 13 of the first sheet guide device 11 and then the second sheet guide device 11 and, if present, the comb plate 16 in the sheet inlet 18. In this case, the second pneumatic system 19 arranged in the sheet inlet 18 again supports the sheet at the underside as it is transferred from the sheet-carrying cylinder 5 to the downstream sheet-carrying cylinder 4 in the transfer area 10.

After the transfer, while the sheet is located resting with its front part in the grip of the grippers fixed on the sheet-carrying cylinder 4, the remaining part of the sheet is still in the area of the sheet-carrying cylinder 5.

The blown air stream (low blowing pressure, high volume flow) produced by the second pneumatic system 19 in the direction of the sheet inlet 18 supports the underside of the sheet at the transition from the sheet guide device 11 or from the comb plate 16 to the downstream sheet-carrying cylinder 4. As a result of the low blowing pressure and high volume flow, the blown air stream produced has the effect that the sheet is guided quietly in this transition without settling onto the comb plate 16 or the guide surface 13 of the sheet guide device 11 (which leads to smearing or marking), until the sheet is resting completely on the sheet-carrying cylinder 4.

In the sheet inlet 18, the second pneumatic system 19 similarly can be controlled in order to support the underside of the sheet, for example from the point of view of the printed subject, the elasticity of the sheet material, and the like. In the case of the preferred design of the pneumatic system 19 with a plurality of fans, for example axial fans, in particular each fan can be controlled individually.

From the foregoing, it can be seen that the air assisted sheet guiding device of the present invention is adapted for more reliable smear and mark-free conveyance of sheets to and from transition areas between two sheet holding and transfer systems. The sheet guide device further is adapted for versatile use in recto printing or recto and verso printing.

What is claimed is:

1. A rotary printing machine comprising a pair of sheet holding and transfer systems disposed in side-by-side relation for transferring sheets in the printing machine, said sheet holding and transfer systems defining a sheet transfer area at a tangential point between said sheet holding and transfer systems, a sheet guide apparatus disposed underneath said transfer area, said sheet guide apparatus including a sheet guide which defines a guide surface for guiding movement of sheets adjacent said transfer area, said sheet guide including a comb shaped end with spaced apart guide fingers adjacent said transfer area, a first pneumatic system for directing air in said sheet guide and through said guide surface for guiding sheet movement along said guide surface, and a second separate pneumatic system operable for blowing an air stream over an external end of said comb and into spaces between said guide fingers and toward said transfer area to facilitate reliable transfer of sheets between said sheet holding and transfer systems.

2. The printing machine of claim 1 in which said sheet holding and transfer systems comprise a pair of sheet carrying cylinders.

3. The printing machine of claim 1 in which said sheet transfer and holding systems comprise one sheet-carrying cylinder and a circulating conveyor system.

4. The printing machine of claim 1 in which said second separate pneumatic system is located adjacent a sheet outlet defined by said sheet holding and transfer systems from which sheets are directed.

5. The printing machine of claim 4 in which said sheet guide includes a first flow duct communicating with openings in said guide surface, said first pneumatic system communicating with said first flow duct, and a second flow duct communicating with said second separate pneumatic system and having at least one discharge outlet opening aimed in the direction of said sheet outlet.

6. The printing machine of claim 1 in which said second separate pneumatic system is located adjacent a sheet inlet defined by said sheet holding and transfer systems into which sheets are directed.

7. The printing machine of claim 6 in which said sheet guide includes a first flow duct communicating with openings in said guide surface, said first a pneumatic system communicating with said first flow duct, and a second flow duct communicating with said second separate pneumatic system and having at least one discharge outlet opening aimed in the direction of said sheet inlet.

8. The printing machine of claim 1 in which said second pneumatic system comprises a plurality of controllable fans for directing a low pressure high, volume air flow.

9. The printing machine of claim 1 in which said second pneumatic system is mounted on said sheet guide.

10. The printing machine of claim 1 in which said sheet guide includes a first flow duct communicating with openings in said guide surface, said first pneumatic system communicating with said first flow duct, and a second flow duct communicating with said second separate pneumatic system and having at least one discharge outlet opening aimed in the direction of the transfer area.

11. A rotary printing machine comprising a pair of sheet holding and transfer systems disposed in side-by-side relation for transferring sheets in the printing machine, said sheet holding and transfer systems defining a sheet transfer area therebetween, a sheet guide apparatus disposed underneath said transfer area, said sheet guide apparatus including a sheet guide which defines a guide surface for guiding movement of sheets adjacent said transfer area, said sheet guide including a comb with spaced apart guide fingers adjacent said transfer area, a first pneumatic system operable for directing air in said sheet guide and through said sheet guide surface for guiding sheet movement alone said guide system, and a second pneumatic system operable for blowing an air stream externally over an end of said comb and into spaces between said guide fingers toward said transfer area to facilitate reliable transfer of sheets between said sheet holding and transfer systems.

12. The rotary printing machine of claim 11 in which said transfer area is defined by a tangent point between said sheet holding and transfer systems.

13. The printing machine of claim 12 in which said sheet holding and transfer systems comprise a pair of sheet carrying cylinders.

14. The printing machine of claim 12 in which said sheet transfer and holding systems comprise one sheet-carrying cylinder and a circulating conveyor system.

15. The printing machine of claim 11 in which said second pneumatic system is mounted on said sheet guide.

16. The printing machine of claim 11 in which said first and second pneumatic systems include a flow duct mounted on said sheet guide, said flow duct having at least one discharge outlet opening oriented in the direction of the transfer area.

17. The printing machine of claim 11 in which said first pneumatic system for directing air in said sheet guide and through said guide surface is separate from the second pneumatic system for blowing an air stream externally over an end of said comb and into the spaces between said guide fingers.

* * * * *